US009541084B2

(12) United States Patent
Ignatiev et al.

(10) Patent No.: US 9,541,084 B2
(45) Date of Patent: Jan. 10, 2017

(54) CAPACITY MODULATED SCROLL COMPRESSOR

(71) Applicant: Emerson Climate Technologies, Inc., Sidney, OH (US)

(72) Inventors: Kirill M. Ignatiev, Sidney, OH (US); Michael M. Perevozchikov, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 106 days.

(21) Appl. No.: 14/173,983

(22) Filed: Feb. 6, 2014

(65) Prior Publication Data

US 2014/0219846 A1 Aug. 7, 2014

Related U.S. Application Data

(60) Provisional application No. 61/761,453, filed on Feb. 6, 2013.

(51) Int. Cl.
*F04C 28/18* (2006.01)
*F04C 18/02* (2006.01)
(Continued)

(52) U.S. Cl.
CPC ..... *F04C 18/0215* (2013.01); *F01C 1/0215* (2013.01); *F04C 18/0253* (2013.01);
(Continued)

(58) Field of Classification Search
CPC ... F04C 18/0215; F04C 23/008; F04C 27/005; F04C 28/26; F04C 27/007; F04C 18/0207; F04C 18/0223; F04C 18/0253; F04C 18/0261; F04C 2270/58; F04C 28/18; F04C 28/265; F04C 29/0021; F04C 29/12; F01C 19/08; F01C 19/10; F01C 20/26; F01C 1/0207; F01C 1/0215; F01C 1/0223; F01C 1/0261; F01C 1/0292
(Continued)

(56) References Cited

U.S. PATENT DOCUMENTS 4,645,437 A * 2/1987 Sakashita ..... F04C 18/0215 277/399
4,669,962 A 6/1987 Mizuno et al.
(Continued)

FOREIGN PATENT DOCUMENTS

CN 2168100 Y 6/1994
CN 1510273 A 7/2004
(Continued)

OTHER PUBLICATIONS

International Search Report regarding Application No. PCT/US2014/015134, mailed Nov. 18, 2014.
(Continued)

*Primary Examiner* — Dominick L Plakkoottam
(74) *Attorney, Agent, or Firm* — Harness, Dickey & Pierce, P.L.C.

(57) ABSTRACT

A capacity modulation assembly is provided and may include a control valve and a first line extending between the control valve and a suction pressure region disposed within a compressor shell, whereby the suction pressure region is in communication with a suction inlet gas fitting extending through a shell of a compressor. The capacity modulation assembly may additionally include a second line extending between the control valve and an intermediate pressure region disposed within the compressor shell, whereby the intermediate pressure region is in communication with compression pockets defined between an orbiting scroll and a non-orbiting scroll.

20 Claims, 9 Drawing Sheets

(51) Int. Cl.

| | |
|---|---|
| ***F01C 1/02*** | (2006.01) |
| ***F04C 23/00*** | (2006.01) |
| ***F04C 27/00*** | (2006.01) |
| ***F04C 28/26*** | (2006.01) |
| *F01C 21/00* | (2006.01) |

(52) U.S. Cl.
CPC ..... *F04C 23/008* (2013.01); *F04C 27/005* (2013.01); *F04C 28/18* (2013.01); *F04C 28/26* (2013.01); *F01C 2021/1643* (2013.01)

(58) Field of Classification Search
USPC ..... 417/410.5; 418/55.5
See application file for complete search history.

(56) References Cited

U.S. PATENT DOCUMENTS 4,993,928 A * 2/1991 Fraser, Jr. ..... F04C 27/005 418/55.4
5,145,345 A * 9/1992 Barito ..... F04C 27/005 277/399
5,591,014 A 1/1997 Wallis et al.
5,607,288 A 3/1997 Wallis et al.
5,611,674 A * 3/1997 Bass ..... F01C 21/102 417/220
5,741,120 A * 4/1998 Bass ..... A47F 3/04 417/214
5,803,716 A 9/1998 Wallis et al.
6,047,557 A 4/2000 Pham et al.
6,123,517 A * 9/2000 Brooke ..... F04C 18/0215 417/299
6,213,731 B1 * 4/2001 Doepker ..... F01C 21/10 417/299
6,821,092 B1 * 11/2004 Gehret ..... F04C 28/265 417/213
7,326,039 B2 * 2/2008 Kim ..... F04C 27/005 418/142
2007/0036661 A1 * 2/2007 Stover ..... F04C 18/0215 417/310
2008/0286118 A1 * 11/2008 Gu ..... F04C 18/0215 417/1
2010/0254841 A1 * 10/2010 Akei ..... F04C 18/0215 418/24
2012/0009076 A1 1/2012 Kim et al.

FOREIGN PATENT DOCUMENTS

CN 1773120 A 5/2006
CN 101755126 A 6/2010
KR 20000046639 A 7/2000

OTHER PUBLICATIONS

Written Opinion of the International Searching Authority regarding Application No. PCT/US2014/015134, mailed Nov. 18, 2014.
Office Action regarding Chinese Patent Application No. 201480012708.7, dated Aug. 10, 2016. Translation provided by Unitalen Attorneys at Law.

* cited by examiner

CAPACITY MODULATED SCROLL COMPRESSOR

CROSS-REFERENCE TO RELATED APPLICATIONS

This application claims the benefit of U.S. Provisional Application No. 61/761,453, filed on Feb. 6, 2013. The entire disclosure of the above application is incorporated herein by reference.

FIELD

The present disclosure relates to capacity modulated scroll compressors.

BACKGROUND

This section provides background information related to the present disclosure which is not necessarily prior art.

A scroll compressor typically includes a drive shaft that drives a compression mechanism and a main bearing housing supporting the drive shaft within a shell assembly. The compression mechanism includes an orbiting scroll, a non-orbiting scroll, and an Oldham coupling. The Oldham coupling prevents relative rotation between the orbiting scroll and the non-orbiting scroll.

SUMMARY

This section provides a general summary of the disclosure, and is not a comprehensive disclosure of its full scope or all of its features.

A compressor is provided and may include a shell defining an opening that receives a suction gas inlet fitting in communication with a suction pressure region disposed within the shell, a bearing housing fixed relative to the shell, and a compression mechanism located within the shell, supported on the bearing housing, and in communication with the suction pressure region. The compression mechanism may include an orbiting scroll and a non-orbiting scroll that include spiral wraps defining compression pockets therebetween. At least one of the orbiting scroll and the non-orbiting scroll may define an intermediate passage that provides communication between the compression pockets and an intermediate pressure region disposed within the shell. The compressor may additionally include a capacity modulation assembly including a control valve, a first line, and a second line, whereby the first line extends between the suction pressure region and the control valve and the second line extends between the intermediate pressure region and the control valve. The control valve may selectively open to provide communication between the intermediate pressure region and the suction pressure region and thereby separate the orbiting scroll and the non-orbiting scroll to reduce the capacity of the compressor.

According to additional features, the first control valve can be disposed outside of the shell and the first and second lines can extend through the shell. According to other features, the first control valve, the first line, and the second line can be disposed within the shell. According to other features, the first and the second lines can be disposed within the shell and the first control valve extends through the shell.

According to still other features, the first control valve can include a valve body, a solenoid coil, and a valve stem. The valve body can define a first bore extending between the first and second lines. The valve stem can extend into the first bore when the first control valve is closed to prevent communication between the first and second lines. According to other features, the intermediate passage can be defined in the orbiting scroll and the intermediate pressure region can be defined between the orbiting scroll and the bearing housing.

According to other features, a seal assembly can be disposed between the orbiting scroll and the bearing housing, the seal assembly preventing communication between the intermediate pressure region and a discharge pressure region disposed within the shell. The seal assembly can bias the orbiting scroll toward the non-orbiting scroll. The seal assembly can include at least one of a spring and a polymeric material. According to one feature, the seal assembly can be at least partially disposed in a groove in the bearing housing, and the spring can bias the polymeric material toward the orbiting scroll. According to another feature, the seal assembly can be at least partially disposed in a groove in the orbiting scroll and the spring can bias the polymeric material toward the bearing housing.

According to other features, the non-orbiting scroll can define a suction passage and a discharge passage. The suction passage can provide communication between the suction pressure region and the compression pockets. The discharge passage can provide communication between the compression pockets and the discharge pressure region. The intermediate passage can extend from the compression pockets at a location between the suction passage and the discharge passage.

According to other features, the compressor can include a suction valve assembly that includes a cap and a spring. The spring can bias the cap toward an end surface of the suction gas inlet fitting. The cap can prevent communication between the suction gas inlet fitting and the suction pressure region when the cap engages the end surface of the suction gas inlet fitting. The non-orbiting scroll can define a bore, the suction valve assembly can be disposed in the bore, and the spring can be captured between the cap and an end surface of the non-orbiting scroll at an end of the bore.

According to other features, the capacity modulation assembly can further include a first check valve, a second check valve, and a third line. The first check valve can be disposed in the second line at a location between the intermediate pressure region and an intersection between the second line and the third line. The second check valve can be disposed in the third line. The third line can extend between the second line and a discharge pressure region disposed within the shell.

According to other features, the capacity modulation assembly can further include a second control valve, a third line, and a fourth line. The third line can place the second control valve in communication with the suction pressure region. The fourth line can place the second control valve in communication with a discharge pressure region disposed within the shell. The second control valve can selectively open to provide communication between the discharge pressure region and the suction pressure region and thereby separate the orbiting scroll and the non-orbiting scroll to reduce the capacity of the compressor.

According to other features, a seal assembly can be at least partially disposed in a groove in the orbiting scroll. The seal assembly can include a seal and a biasing member. The biasing member can bias the seal against the non-orbiting scroll to create a seal between the suction pressure region and the intermediate pressure region.

According to other features, the compressor can include a control module that cycles the first control valve using a pulse width modulated (PWM) signal. According to other features, the first line can enter the suction pressure region between the compression pockets and a suction valve assembly.

A capacity modulation assembly is provided and may include a control valve and a first line extending between the control valve and a suction pressure region disposed within a compressor shell, whereby the suction pressure region is in communication with a suction inlet gas fitting extending through a shell of a compressor. The capacity modulation assembly may additionally include a second line extending between the control valve and an intermediate pressure region disposed within the compressor shell, whereby the intermediate pressure region is in communication with compression pockets defined between an orbiting scroll and a non-orbiting scroll.

According to additional features, the first control valve can selectively open to provide communication between the suction pressure region and the intermediate pressure region. According to other features, the first control valve can include a solenoid valve. According to other features, the first control valve can include a valve body, a solenoid coil, and a valve stem. The valve body can define a bore extending between the first and second lines. The valve stem can extend into the bore when the first control valve is closed to prevent communication between the first and second lines.

According to other features, the capacity modulation assembly can include a first check valve, a second check valve, and a third line. The first check valve can be disposed in the second line, and the second check valve can be disposed in the third line. The third line can be configured to extend between the second line and a discharge pressure region disposed within the shell.

According to other features, the capacity modulation assembly can include a second control valve, a third line, and a fourth line. The third line can be configured to place the second control valve in communication with the suction pressure region. The fourth line can be configured to place the second control valve in communication with a discharge pressure region disposed within the shell. The second control valve can selectively open to provide communication between the discharge pressure region and the suction pressure region and thereby separate the orbiting scroll and the non-orbiting scroll to reduce the capacity of the compressor.

A compressor is provided and may include a shell defining an opening that receives a suction gas inlet fitting extending into a suction pressure region disposed within the shell, a bearing housing fixed relative to the shell, and a compression mechanism located within the shell, supported on the bearing housing, and in communication with the suction pressure region. The compression mechanism may include an orbiting scroll and a non-orbiting scroll that include spiral wraps defining compression pockets therebetween. The orbiting scroll and the bearing housing may define an intermediate pressure region therebetween. Further, the orbiting scroll may define an intermediate passage that extends between the compression pockets and the intermediate pressure region. A capacity modulation assembly may include a control valve, a first line, and a second line, whereby the first line extends between the suction pressure region and the control valve and the second line extends between the intermediate pressure region and the control valve. The control valve may selectively open to allow gas to flow from the intermediate pressure region to the suction pressure region.

According to additional features, a seal assembly can be disposed between the orbiting scroll and the bearing housing. The seal assembly can prevent communication between the intermediate pressure region and a discharge pressure region disposed within the shell.

According to other features, the compressor can include a suction valve assembly that includes a cap and a spring. The spring can bias the cap toward an end surface of the suction gas inlet fitting. The cap can prevent communication between the suction gas inlet fitting and the suction pressure region when the cap engages the end surface of the suction gas inlet fitting.

According to still other features, a seal assembly can be disposed between the orbiting scroll and the non-orbiting scroll. The seal assembly can prevent communication between the intermediate pressure region and the suction pressure region.

A compressor is provided and may include a shell defining a suction pressure region disposed within the shell and a discharge pressure region disposed within the shell, a bearing housing fixed relative to the shell, and a compression mechanism located within the shell, supported on the bearing housing and in communication with the suction pressure region. The compression mechanism may include an orbiting scroll and a non-orbiting scroll that include spiral wraps defining compression pockets therebetween. A capacity modulation assembly may include a control valve in communication with the suction pressure region and at least one of the discharge pressure region and an intermediate pressure region disposed within the shell. The capacity modulation assembly may also include a control module that opens and closes the control valve in a pulsed manner to separate and reengage the orbiting and non-orbiting scrolls and thereby vary the capacity of the compressor.

According to additional features, the control module can open and close the control valve using a pulse width modulated (PWM) signal. According to other features, the control module can use the PWM signal to control a ratio of a first period when the orbiting and non-orbiting scrolls are engaged to a sum of the first period and a second period when the orbiting and non-orbiting scrolls are separated.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
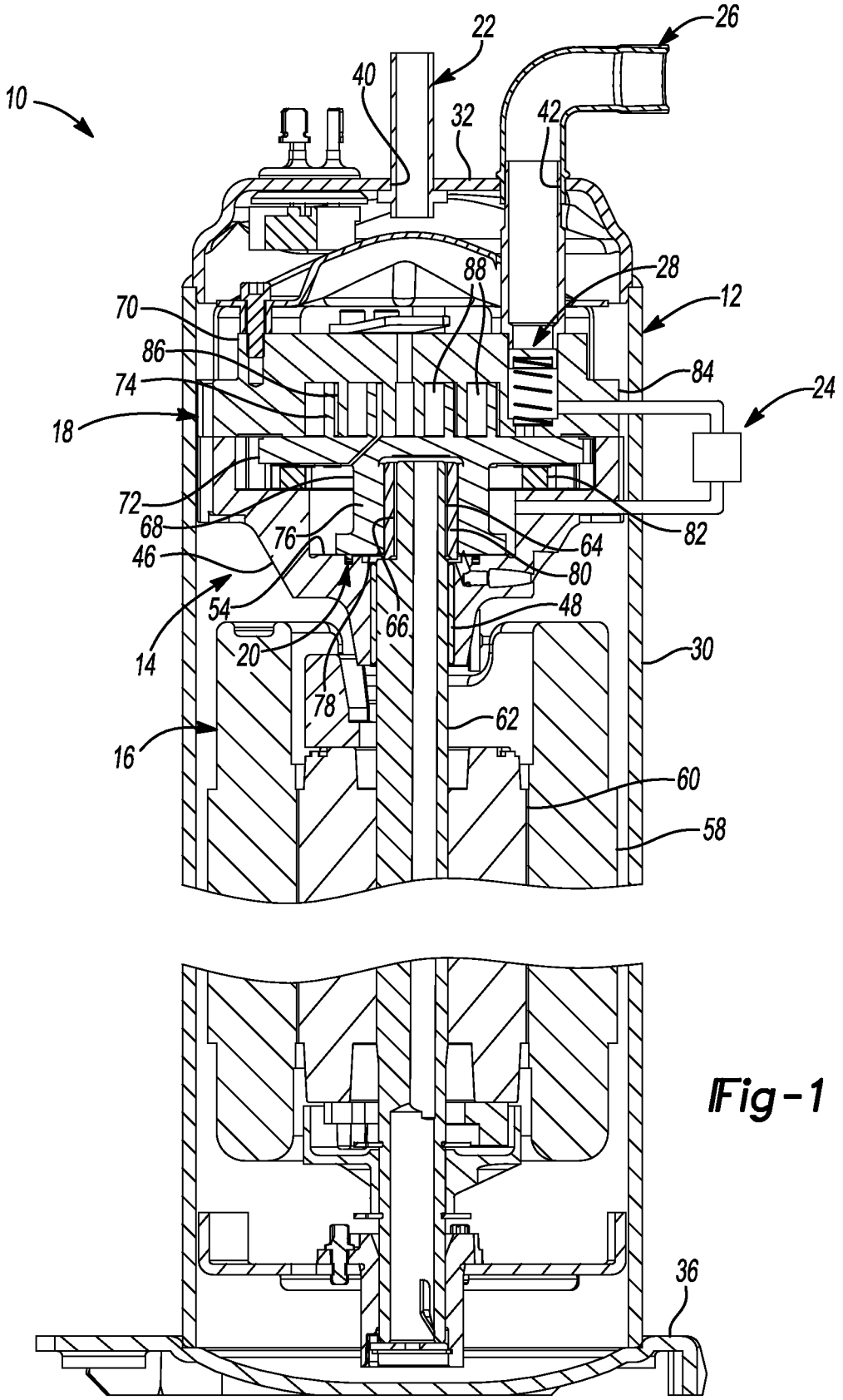
FIG. 1 is a section view of a compressor assembly according to the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present teachings are suitable for incorporation in many different types of scroll and rotary compressors, including hermetic machines, open-drive machines and non-hermetic machines. For exemplary purposes, a compressor 10 is shown as a hermetic scroll refrigerant-compressor of the high-side type, i.e., where the interior of the hermetic shell is filled with discharge gas.

With reference to FIG. 1, the compressor 10 may include a hermetic shell assembly 12, a bearing housing assembly 14, a motor assembly 16, a compression mechanism 18, a seal assembly 20, a refrigerant discharge fitting 22, a capacity modulation assembly 24, a suction gas inlet fitting 26, and a suction valve assembly 28. The shell assembly 12 may house the bearing housing assembly 14, the motor assembly 16, the compression mechanism 18, the seal assembly 20, and the suction valve assembly 28.

The shell assembly 12 may form a compressor housing and may include a cylindrical shell 30, an end cap 32 at the upper end thereof, and a base 36 at a lower end thereof. The refrigerant discharge fitting 22 may be attached to the shell assembly 12 at a first opening 40 formed in the end cap 32 while the suction gas inlet fitting 26 may be attached to the shell assembly 12 at a second opening 42 formed in the end cap 32.

The bearing housing assembly 14 may be affixed to the shell 30 at a plurality of points in any desirable manner, such as staking. The bearing housing assembly 14 may include a bearing housing 46 and a bearing 48. The bearing housing 46 may house the bearing 48 therein and may define an annular flat surface 54 on an axial end surface thereof.

The motor assembly 16 may generally include a motor stator 58, a rotor 60, and a drive shaft 62. The motor stator 58 may be press fit into shell 30. The drive shaft 62 may be rotatably driven by the rotor 60 and may be rotatably supported within the bearing housing assembly 14. The rotor 60 may be press fit on the drive shaft 62. The drive shaft 62 may include an eccentric crank pin 64 having a flat 66 thereon (FIG. 1).

The compression mechanism 18 may generally include an orbiting scroll 68 and a non-orbiting scroll 70. The orbiting scroll 68 may include an end plate 72 having a spiral vane or wrap 74 on the upper surface thereof. A cylindrical hub 76 may project downwardly from the lower surface of the end plate 72 and may have an annular flat surface 78 on the lower surface thereof. The annular flat surface 78 on the orbiting scroll 68 and the annular flat surface 54 on the bearing housing 46 may be separated from one another such that a clearance gap is disposed between the surfaces (54, 78).

The cylindrical hub 76 may have a drive bushing 80 rotatably disposed therein. The drive bushing 80 may include an inner bore in which the crank pin 64 is drivingly disposed. The crank pin flat 66 may drivingly engage a flat surface in a portion of the inner bore of the drive bushing 80 to provide a radially compliant driving arrangement. An Oldham coupling 82 may be engaged with the orbiting and non-orbiting scrolls 68, 70 to prevent relative rotation therebetween when the orbiting scroll 68 is driven by the drive shaft 62.

The non-orbiting scroll 70 may include an end plate 84 having a spiral wrap 86 on a lower surface thereof. Compression pockets 88 may be defined between the spiral wrap 74 of the orbiting scroll 68 and the spiral wrap 86 of the non-orbiting scroll 70.

Figure 2:
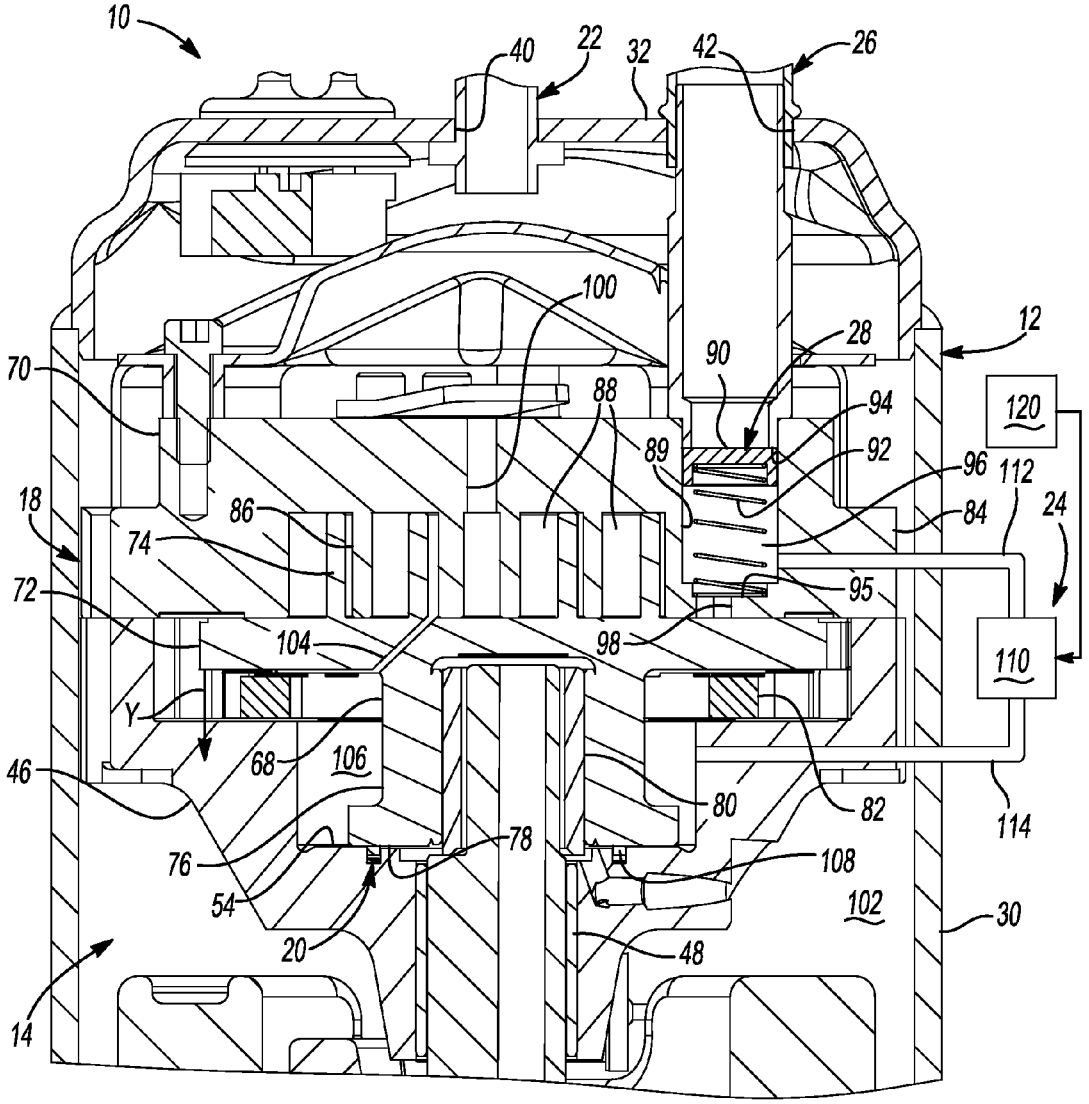
FIG. 2 is a section view of a portion of the compression assembly of FIG. 1.
Figure 3:
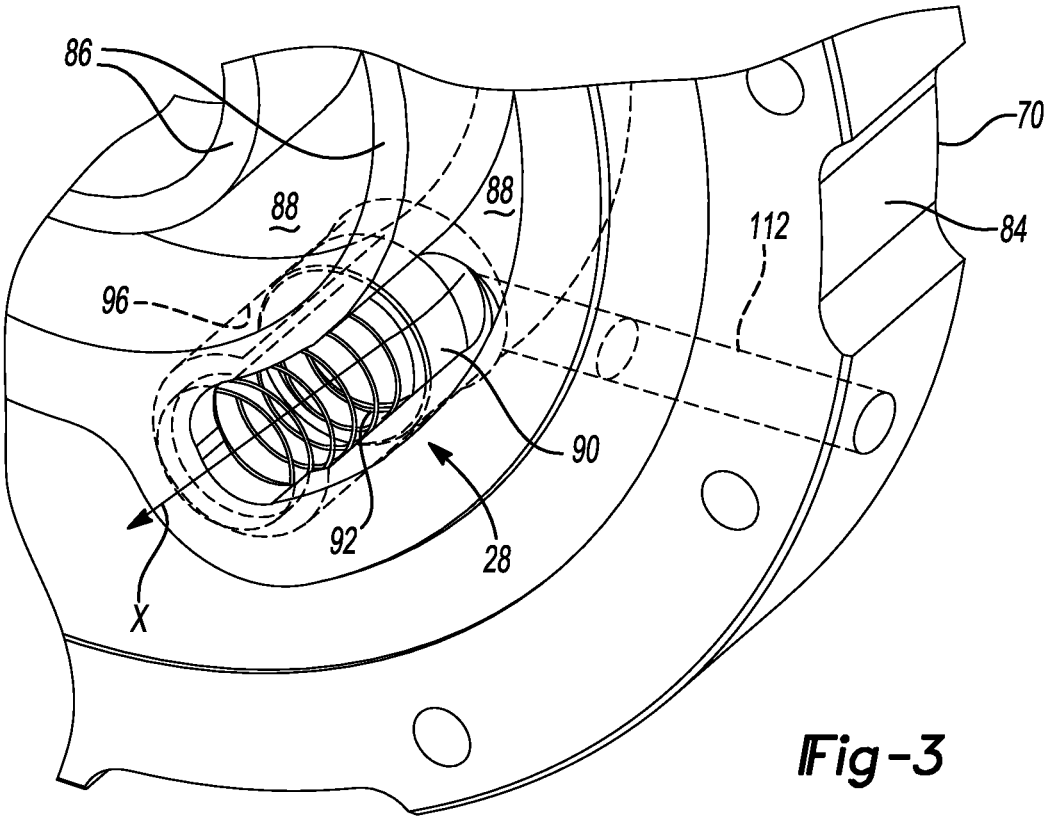
FIG. 3 is a perspective view of a portion of the compression assembly of FIG. 1.

The suction valve assembly 28 may act as a check valve by allowing suction gas to enter the compression pockets 88 while preventing gas from flowing in the reverse direction through the suction gas inlet fitting 26. With reference to FIGS. 2 and 3, the suction valve assembly 28 may be disposed in an axial bore 89 formed in the non-orbiting scroll 70 and may include a cap 90 and a spring 92 that biases the cap 90 toward a lower axial end surface 94 of the suction gas inlet fitting 26. As shown in FIG. 2, the lower axial end surface 94 of the suction gas inlet fitting 26 extends into the axial bore 89 and opposes the cap 90. The spring 92 may be captured between the cap 90 and an upper axial end surface 95 of the non-orbiting scroll 70 at the bottom of the axial bore 89. The cap 90 and the non-orbiting scroll 70 may cooperate to define a suction chamber 96.

The cap 90 selectively engages the lower axial end surface 94 of the suction gas inlet fitting 26 depending on the balance of a force acting on an upper surface of the cap 90 due to the pressure of the gas disposed within the suction gas inlet fitting 26 and a force acting on a lower surface of the cap 90 due to the spring 92 and due to the pressure of the gas disposed within the suction chamber 96. When the force acting on the upper surface of the cap 90 is greater than the force acting on the lower surface of the cap 90, the cap 90 disengages the lower axial end surface 94 of the suction gas inlet fitting 26. In turn, suction gas is allowed to flow around the cap 90 and into the suction chamber 96, as indicated by the arrow (X) in FIG. 3. When the force acting on the upper surface of the cap 90 is less than the force acting on the lower surface of the cap 90, the cap 90 engages the lower axial end surface 94 of the suction gas inlet fitting 26, as shown in FIG. 2. In turn, gas disposed within the suction chamber 96 is prevented from exiting the compressor 10 through the suction gas inlet fitting 26 by the cap 90.

Gas disposed in the suction chamber 96 may be at suction pressure and may enter the compression pockets 88 through a suction passage 98 formed in the non-orbiting scroll 70 near the outer perimeter of the compression mechanism 18. During normal operation, gas disposed in the compression pockets 88 is forced radially inward toward the center of the compression mechanism 18 as the orbiting scroll 68 orbits relative to the non-orbiting scroll 70. As gas moves toward the center of the compression mechanism 18, the pressure of the gas increases until the gas reaches discharge pressure. Thus, the pressure of the gas at the center of the compression mechanism 18 is greater than the pressure of the gas at the outer perimeter of the compression mechanism 18. Discharge-pressure gas may exit the compression pockets 88 through a discharge passage 100 defined in the non-orbiting scroll 70 at or near the center of the compression mechanism. Discharge-pressure gas may fill a discharge chamber 102 defined by the shell assembly 12 and may exit the compressor 10 through the refrigerant discharge fitting 22.

An intermediate passage 104 may extend through the orbiting scroll 68 and may provide communication between the compression pockets 88 and an intermediate chamber 106. The intermediate passage 104 may extend from the compression pockets 88 at a location between the suction passage 98 and the discharge passage 100 (e.g., between the center of the compression mechanism 18 and the outer perimeter of the compression mechanism 18). Thus, the gas disposed within the intermediate chamber 106 may be at an intermediate pressure that is greater than the suction-pressure gas disposed within the suction chamber 96 and is less than the discharge-pressure gas disposed within the discharge chamber 102.

The seal assembly 20 may prevent communication between the intermediate chamber 106 and the discharge chamber 102. The seal assembly 20 may also engage the annular flat surface 78 on the orbiting scroll 68 to bias the orbiting scroll 68 toward the non-orbiting scroll 70. The seal assembly 20 may include a spring and/or an elastic or polymeric material such as elastomer and may be at least partially disposed in an annular groove 108 defined in the bearing housing 46. The axial compliance of the seal assembly 20 allows the orbiting scroll 68 to move axially away from the non-orbiting scroll 70 when the net force acting on the orbiting scroll 68 urges the orbiting scroll 68 in the direction (Y; FIG. 2) while still maintaining a seal between the bearing housing 46 and the orbiting scroll 68.

The capacity modulation assembly 24 may selectively separate the orbiting scroll 68 from the non-orbiting scroll 70 to decrease the capacity of the compressor 10. The capacity of the compressor 10 may be decreased when demand on the compressor 10 is reduced in order to improve the efficiency of the compressor 10. The capacity modulation assembly 24 may include a control valve 110 such as a solenoid valve, a first line 112 extending between the suction chamber 96 and the control valve 110, and a second line 114 extending between the control valve 110 and the intermediate chamber 106. The first line 112 may enter the suction chamber 96 at a location between the compression pockets 88 and the suction valve assembly 28, as shown. In various implementations, the portions of the first line 112 and the second line 114 extending parallel to the longitudinal axis of the shell 30 may comprise a third line that is separate from and attached to the portions of the first line 112 and the second line 114 extending perpendicular to the longitudinal axis of the shell 30.

Figure 4:
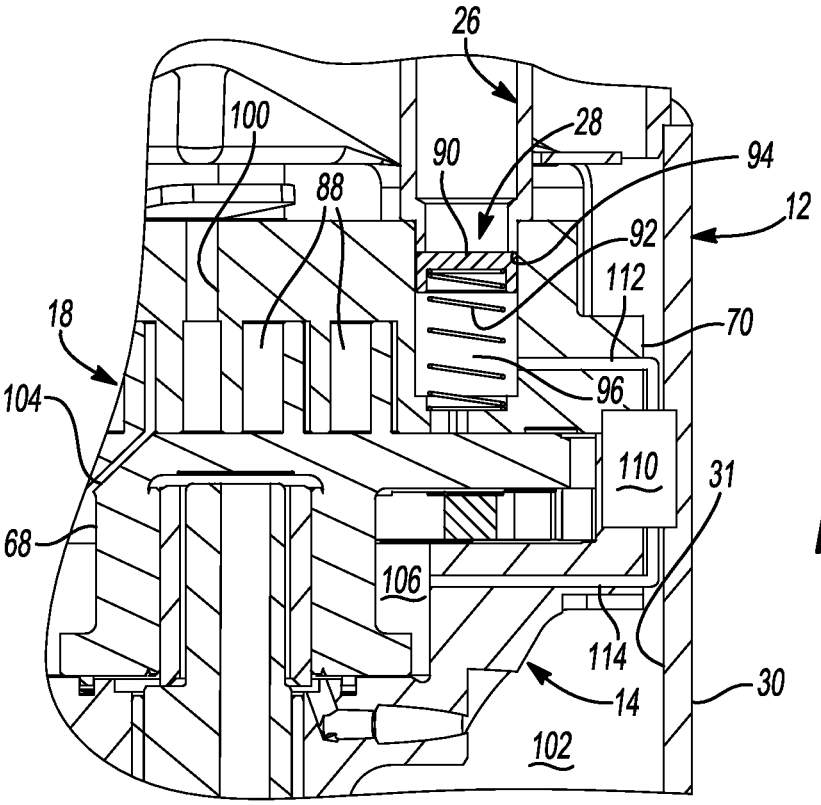
FIG. 4 is a fragmented section view of a first alternative embodiment of a compressor assembly according to the present disclosure.

In the embodiment shown in FIG. 2, the control valve 110 is disposed outside of the shell assembly 12, the first line 112 extends through the shell 30 and the non-orbiting scroll 70, and the second line 114 extends through the shell 30 and the orbiting scroll 68. In this configuration, the control valve 110 may be attached to the outer surface of the shell 30. In other configurations, however, the control valve 110 may be disposed within the shell assembly 12. For example and with reference to FIG. 4, the control valve 110 may be attached to the shell 30 proximate to an inner surface 31 of the shell 30 and between the non-orbiting scroll 70 and the bearing housing 46. In this configuration, the first and second lines 112, 114 may be disposed within the shell assembly 12.

Figure 5A:
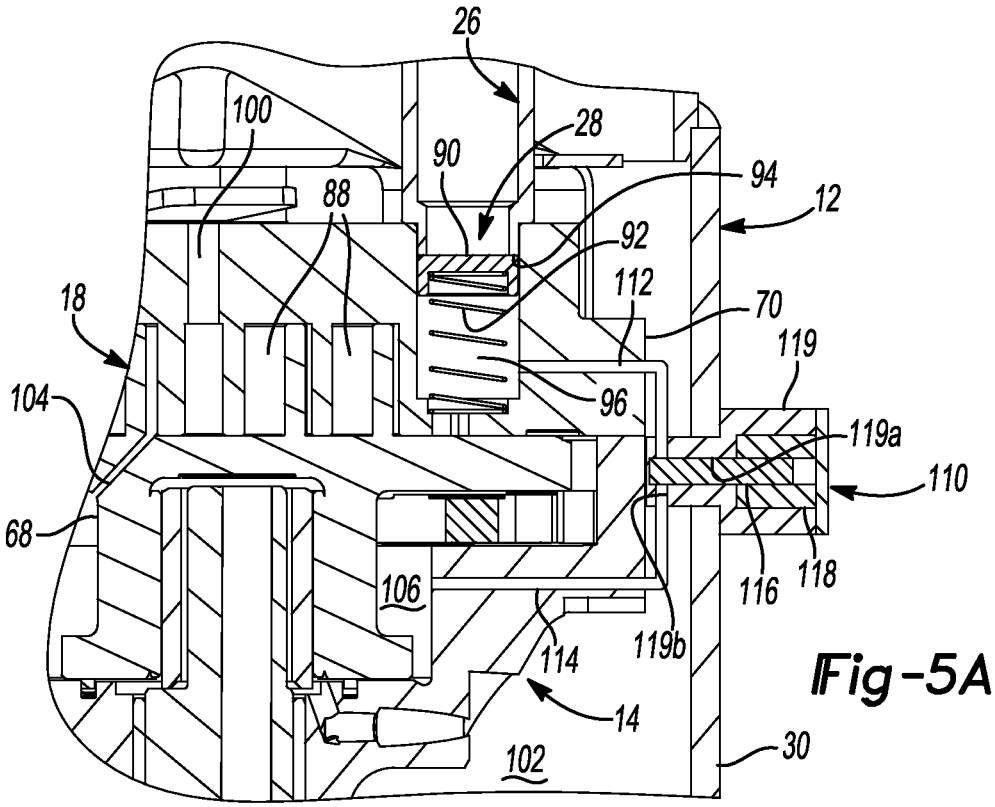
FIGS. 5A and 5B are section views of a portion of a second alternative embodiment of a compressor assembly according to the present disclosure.
Figure 5B:
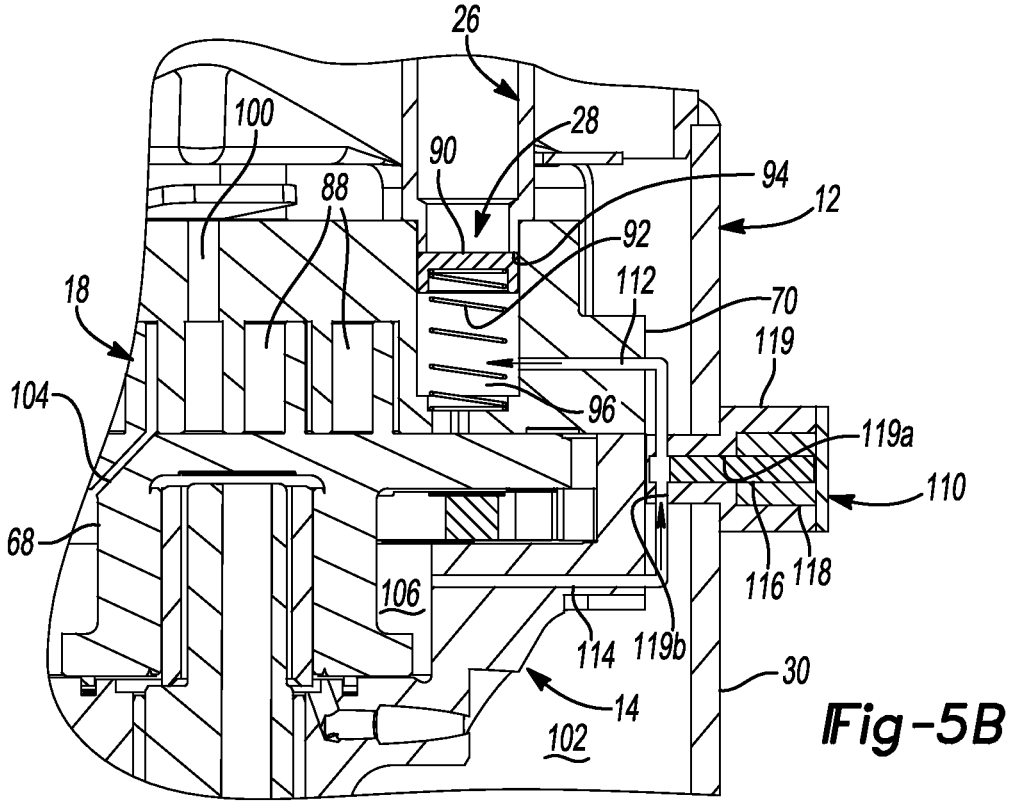

In still other configurations, components of the control valve 110 that require servicing may be disposed at least partially outside of the shell assembly 12 while the remainder of the control valve 110 may be disposed within the shell assembly 12. For example and with reference to FIGS. 5A and 5B, the control valve 110 may include a valve stem 116, a solenoid coil 118, and a valve body 119 that are at least partially disposed outside of the shell assembly 12, while the first and second lines 112, 114 may be disposed within the shell assembly 12. This arrangement provides access to the internal components of the control valve 110 for replacing the valve stem 116 and/or the solenoid coil 118, for example. The valve body 119 defines a radial bore 119*a* that receives the valve stem 116 and an axial bore 119*b* that provides communication between the first and second lines 112, 114 when the valve stem 116 is retracted. When the control valve 110 is closed (FIG. 5A), the valve stem 116 moves radially inward relative to the solenoid coil 118 to prevent communication between the first and second lines 112, 114. When the control valve 110 is opened (FIG. 5B), the valve stem 116 retracts within the solenoid coil 118 to allow gas to flow through the axial bore 119*b* of the valve body 119.

Figure 6:
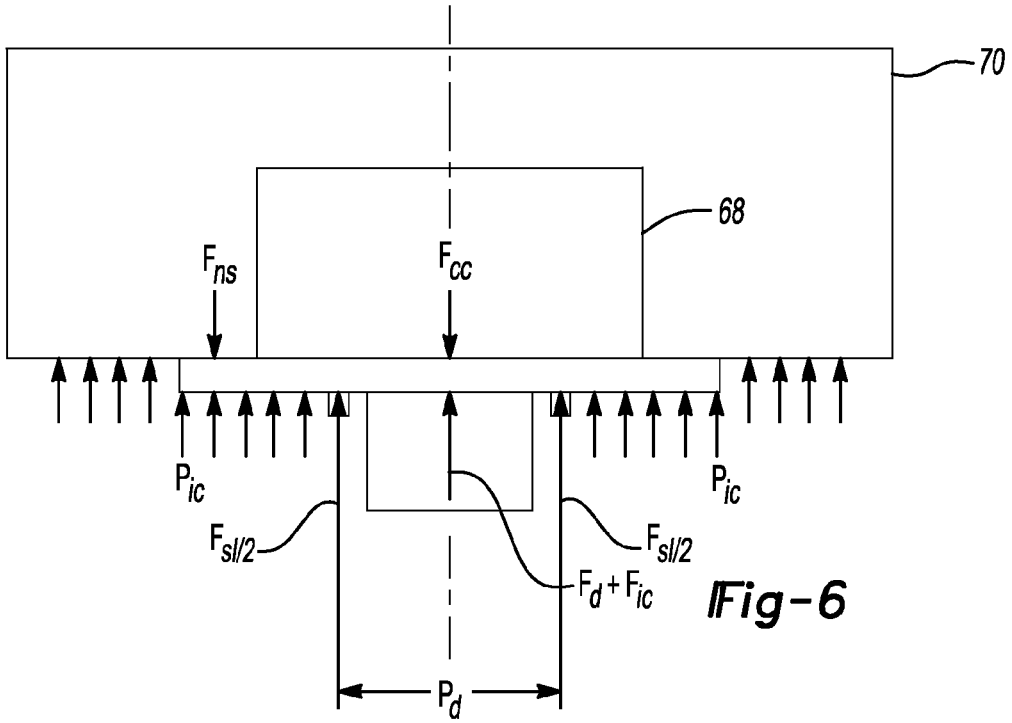
FIG. 6 is a free body diagram illustrating forces acting on orbiting and non-orbiting scrolls of a compressor assembly according to the present disclosure.

The orbiting scroll 68 engages or disengages from the non-orbiting scroll 70 depending on the forces acting on the upper surface of the orbiting scroll 68 and the forces acting on the lower surface of the orbiting scroll 68. With reference to FIG. 6, the forces acting on the upper surface of the orbiting scroll 68 include a force (Fcc) caused by the pressure of the gas disposed within the compression pockets 88 and a force (Fns) caused by contact with the non-orbiting scroll 70. The forces acting on the lower surface of the orbiting scroll 68 include a force (Fd) caused by the pressure of the discharge-pressure gas disposed within the discharge chamber 102, a force (Fic) caused by the pressure of the intermediate-pressure gas disposed within the intermediate chamber 106, and a force (Fsl) caused by the seal assembly 20 acting on the bearing housing 46 and the orbiting scroll 68. The force (Fns) caused by contact with the non-orbiting scroll 70 is equal to the net force (Fnt) urging the orbiting scroll 68 into contact with the non-orbiting scroll 70, which may be calculated using the following equation:

$$Fnt=Fd+Fic+Fsl-Fcc \quad (1)$$

With reference to FIGS. 2 and 6, the control valve 110 is closed during normal operation to prevent communication between the intermediate chamber 106 and the suction chamber 96. When the control valve 110 is closed, a pressure (Pic) within the intermediate chamber 106 is greater than a pressure (Ps) within the suction chamber 96 and less than a pressure (Pd) within the discharge chamber 102. As a result, the net force (Fnt) urging the orbiting scroll 68 into contact with the non-orbiting scroll 70 is positive, and the orbiting scroll 68 is maintained in engagement with the non-orbiting scroll 70.

When demand on the compressor 10 is reduced, the control valve 110 may be opened to provide communication between the intermediate chamber 106 and the suction chamber 96. When the control valve 110 is open, intermediate-pressure gas from the intermediate chamber 106 may flow through the second line 114, through the control valve 110, and through the first line 112 to the suction chamber 96. In turn, the pressure (Pic) within the intermediate chamber 106 is reduced and the pressure in the suction chamber 96 (Ps) is increased. As a result, the net force (Fnt) urging the orbiting scroll 68 into contact with the non-orbiting scroll 70 becomes negative and the orbiting scroll 68 starts to move axially out of engagement with the non-orbiting scroll 70.

The pressure (Pic) within the intermediate chamber 106 may continue to decrease until the pressure (Pic) within the intermediate chamber 106 intersects the pressure (Ps) in the suction chamber 96. At that point, the orbiting scroll 68 separates from the non-orbiting scroll 70 and the capacity of the compressor 10 is reduced. In turn, discharge-pressure gas (Pd) from the discharge chamber 102 fills the suction chamber 96 and the intermediate chamber 106. As a result, the pressure (Ps) in the suction chamber 96 and the pressure (Pic) within the intermediate chamber 106 increase until the two pressures are equal to the pressure (Pd) in the discharge chamber 102.

Figure 7:
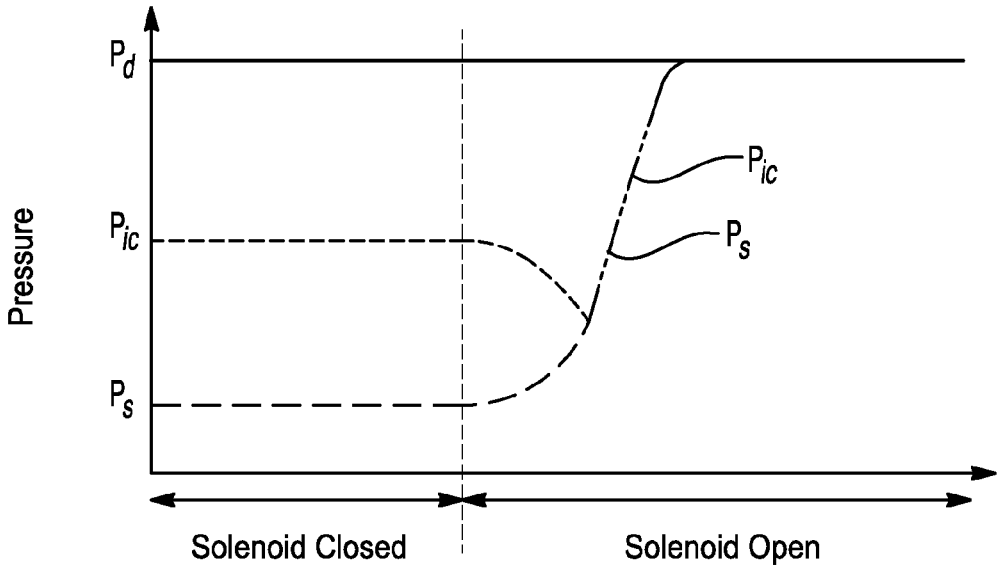
FIG. 7 is a graph illustrating pressures within a compressor assembly according to the present disclosure as the capacity of the compressor is modulated.

When demand on the compressor 10 increases, the control valve 110 may be closed to prevent communication between the suction chamber 96 and the intermediate chamber 106. In turn, the net force (Fnt) urging the orbiting scroll 68 into contact with the non-orbiting scroll 70 may again be positive, and the orbiting scroll 68 may be moved axially into engagement with the non-orbiting scroll 70. As a result, the pressure (Ps) in the suction chamber and the pressure (Pic) in the intermediate chamber may return to the levels indicated in FIG. 7 before the control valve 110 is opened.

A control module 120 may open and close the control valve 110 in a pulsed manner to vary the capacity of the compressor 10. In one example, the control module 120 may open and close the control valve 110 using a pulse width modulated (PWM) signal. The PWM signal may indicate a desired cycle time and/or a desired duty cycle. Cycle time may be a sum of a first period when the compressor 10 is loaded (i.e., when the orbiting and non-orbiting scrolls 68, 70 are engaged) and a second period when the compressor 10 is unloaded (i.e., when the orbiting and non-orbiting scrolls 68, 70 are disengaged or separated). The first period may begin when the compressor 10 is initially loaded and may end when the compressor 10 is initially unloaded. The second period may begin when the compressor 10 is initially unloaded and may end when the compressor 10 is initially loaded. Thus, the cycle time may be the period of a single cycle, which may consist of a single loading event and a single unloading event.

The cycle time may be a predetermined period (e.g., a period between 5 seconds and one minute, a period between 10 seconds and 30 seconds, and/or a period equal to 10 seconds or 20 seconds). Preferably, the cycle time will be substantially less than the time constant of the system load which may typically be in the range of about one to several minutes. In a preferred embodiment, the cycle time may be as much as 4 to 8 times less than the thermal time constant of the load or even greater. The thermal time constant of a system may be defined as the length of time the compressor is required to run in order to enable the system to cool the load from an upper limit temperature at which the system is set to turn on, down to a point at which the evaporator pressure reaches a lower limit at which the compressor is shut down.

Duty cycle may be a ratio of the first period when the compressor 10 is loaded to the cycle time. The control module 120 may adjust the duty cycle of the compressor 10 to vary the capacity of the compressor 10 between essentially zero and 100 percent.

The control module 120 may generate the PWM signal. In addition, the control module 120 may generate a valve control signal based on the PWM signal and may output the valve control signal to the control valve 110. The control valve 110 may open and close in response to the valve control signal. In one example, the valve control signal may be a voltage signal and/or the control valve 110 may actuate between a fully open position and a fully closed position in response to the valve control signal. The control module 120 may be included in the capacity modulation assembly 24.

With continued reference to FIG. 2, the stiffness of the seal assembly 20 and the amount of clearance between the annular flat surface 54 on the bearing housing 46 and the annular flat surface 78 on the orbiting scroll 68 may affect the periods required to disengage and reengage the orbiting and non-orbiting scrolls 68, 70. For example, increasing the stiffness of the seal assembly 20 and/or decreasing the gap between the annular flat surfaces 54, 78 may increase the time required to disengage the orbiting and non-orbiting scrolls 68, 70, as the pressure in the intermediate chamber 106 decreases slower when there is a smaller gap between the scrolls 68, 70. In addition, contact between the seal assembly 20 and/or the annular flat surfaces 54, 78 may increase frictional losses.

Decreasing the stiffness of the seal assembly 20 and/or increasing the gap between the annular flat surfaces 54, 78 may increase the time required to reengage the orbiting and non-orbiting scrolls 68, 70, as the pressure in the intermediate chamber 106 increases slower when there is a greater gap between the scrolls 68, 70. In addition, the orbiting scroll 68 may be wobbly, which may increase noise and vibration. Thus, the stiffness of the seal assembly 20 and the amount of clearance between the annular flat surfaces 54, 78 may be selected based on a balance between several factors including scroll disengagement and reengagement periods, frictional losses, noise, and vibration.

As discussed above, the seal assembly 20 may prevent communication between the intermediate chamber 106 and the discharge chamber 102 and may bias the orbiting scroll 68 toward the non-orbiting scroll 70. The seal assembly 20 may be disposed in the annular groove 108 in the main bearing housing 46 and may include a spring that biases a seal against the annular flat surface 78 on the orbiting scroll 68.

Figure 8:
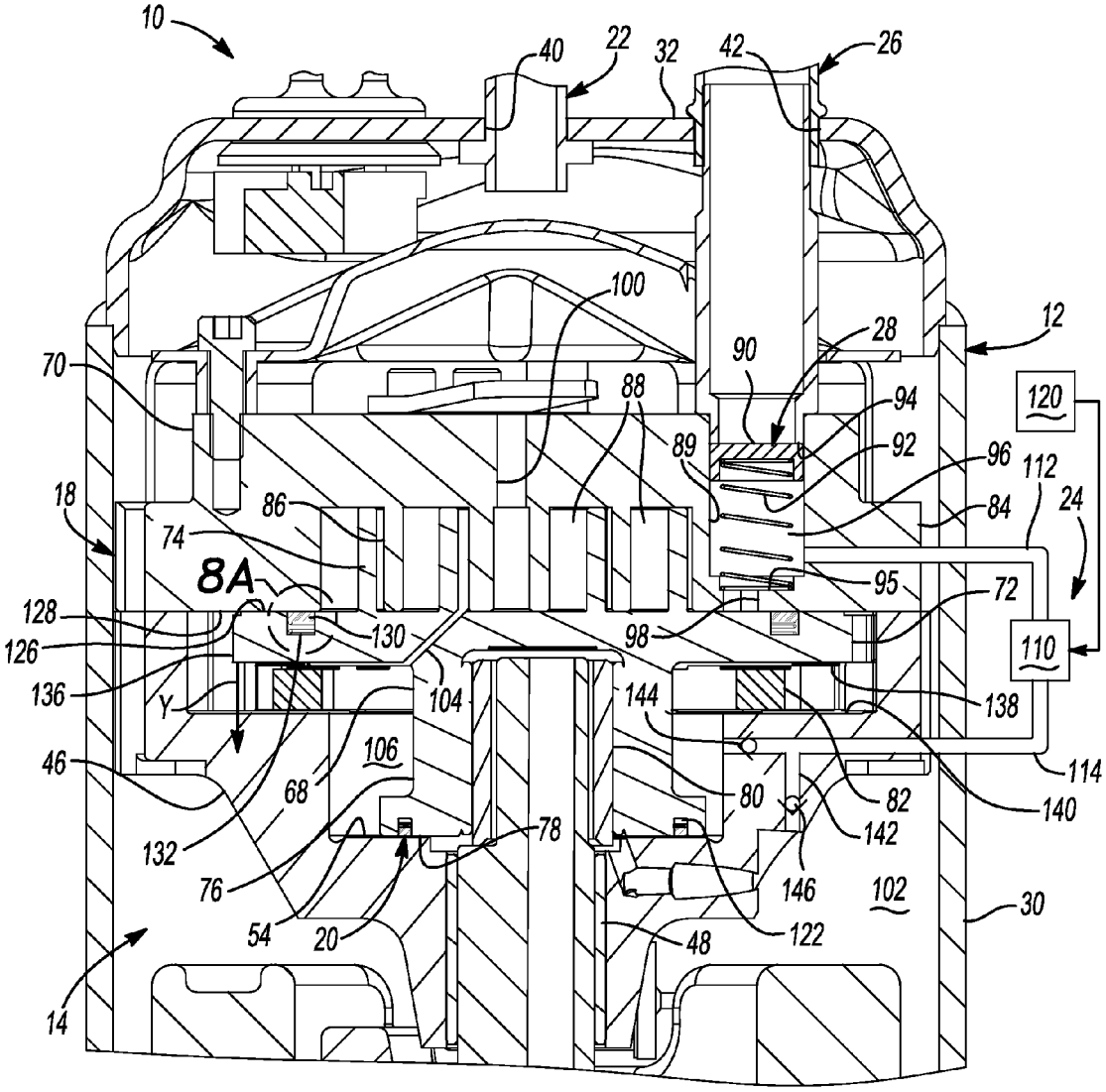
FIG. 8 is a section view of a portion of a third alternative embodiment of a compressor assembly according to the present disclosure.
Figure 8A:
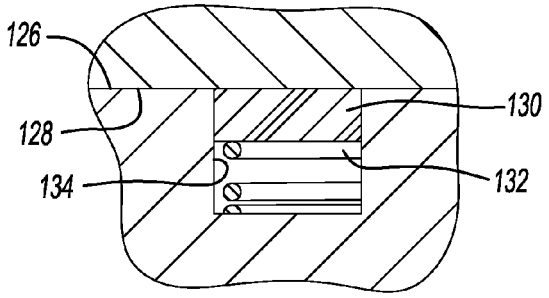
FIG. 8A is a portion of the compressor assembly of FIG. 8 within a circle 8A shown in FIG. 8.

Alternatively, with reference to FIGS. 8 and 8A, the seal assembly 20 may be disposed in an annular groove 122 in the orbiting scroll 68 and may include a spring that biases a seal against the annular flat surface 54 on the main bearing housing 46. In various implementations (not shown), the seal assembly 20 may be disposed in the annular groove 108 of the main bearing housing 46, or the seal assembly 20 may be disposed in the annular groove 122 of the orbiting scroll 68.

The amount of clearance between an annular flat surface 126 on the orbiting scroll 68 and an annular flat surface 128 on the non-orbiting scroll affects the amount of power consumed by the compressor 10 when the compressor 10 is unloaded (e.g., when the orbiting and non-orbiting scrolls 68, 70 are disengaged). The gap or clearance between the annular flat surfaces 126, 128 varies between a minimum clearance and a maximum clearance as the seal 20 compresses and expands. Increasing the maximum clearance between the annular flat surfaces 126, 128 decreases the power consumed by the compressor 10 when the compressor 10 is unloaded. However, increasing the maximum clearance may also increase the amount of time required to reengage the orbiting and non-orbiting scrolls 68, 70 due to leakage from the intermediate chamber 106 to the suction chamber 96 through the gap between the annular flat surfaces 80, 82.

To prevent such leakage, a compliant annular seal 130 can be used to create a seal between the annular flat surfaces 126, 128 of the orbiting and non-orbiting scrolls 68, 70. The annular seal 130 can be formed from a polymer such as an elastomer. In addition, an annular biasing member 132, such as a spring, can be used to bias the annular seal 130 against the annular flat surface 128 of the non-orbiting scroll 70 and thereby maintain a seal between the orbiting and non-orbiting scrolls 68, 70 when the orbiting and non-orbiting scrolls 68, 70 are disengaged. The annular seal 130 and the annular biasing member 132 can be disposed in an annular groove 134 in the oribiting scroll 68 adjacent to an outer periphery 136 of the orbiting scroll 68 as shown. Alternatively, the annular seal 130 and the annular biasing member 132 can be disposed in an annular groove (not shown) in the non-oribiting scroll 70 and the annular biasing member 132 can bias the annular seal 130 against the orbiting scroll 68.

In various implementations, the annular seal 130 and the annular biasing member 132 can be used to create a seal between an annular flat surface 138 of the orbiting scroll 68 and an annular flat surface 140 of the main bearing housing 46. In one example, the annular seal 130 and the annular biasing member 132 can be disposed in an annular groove (not shown) in the orbiting scroll 68, and the annular biasing member 132 can bias the annular seal 130 against the annular flat surface 140 of the main bearing housing 46. In another example, the annular seal 130 and the annular biasing member 132 can be disposed in an annular groove (not shown) in the main bearing housing 46 and the annular biasing member 132 can bias the annular seal 130 against the annular flat surface 138 of the orbiting scroll 68.

As discussed above, when demand on the compressor 10 is reduced, the control valve 110 may be opened to allow intermediate-pressure gas from the intermediate chamber 106 to flow to the suction chamber 96 and thereby increase the pressure in the suction chamber 96. In turn, the net force urging the orbiting scroll 68 into contact with the non-orbiting scroll 70 becomes negative and the orbiting scroll 68 starts to move axially out of engagement with the non-orbiting scroll 70. Thus, increasing the pressure in the intermediate chamber 106 may increase the pressure in the suction chamber 96 when the control valve 110 is opened and thereby decrease the time required to unload the compressor 10 (i.e., disengage the orbiting and non-orbiting scrolls 68, 70).

Depending on the operating conditions of the compressor 10, the pressure in the intermediate chamber 106 may be greater than or less than the pressure in the discharge chamber 102. Thus, to decrease the time required to disengage the orbiting and non-orbiting scrolls 68, 70, the suction chamber 96 may be placed in communication with whichever one of the discharge and intermediate chambers 102, 106 is at the greatest pressure. Therefore, a third line 142 extends between the second line 114 and the intermediate chamber 106 to place the control valve 110 in communication with the discharge chamber 102. In addition, a check valve 144 is disposed in the second line 114 and a check valve 146 is disposed in the third line 142 to control which one of the discharge and intermediate chambers 102, 106 are placed in communication with the suction chamber 96 when the control valve 110 is open. The check valve 144 is disposed in the second line 114 between the intermediate chamber 106 and the intersection of the second and third lines 114, 142. The third line 142, the check valve 144, and/or the check valve 146 may be included in the capacity modulation assembly 24.

If the pressure in the intermediate chamber 106 is greater than the pressure in the discharge chamber 102 when the control valve 110 is open, gas from the intermediate chamber 106 flows to the suction chamber 96 through the check valve 144. In addition, the pressure difference between the intermediate chamber 106 and the discharge chamber 102 causes the check valve 146 to close and thereby prevents communication between the discharge chamber 102 and the suction chamber 96. If the pressure in the discharge chamber 102 is greater than the pressure in the intermediate chamber 106 when the control valve 110 is open, gas from the discharge chamber 102 flows to the suction chamber 96 through the check valve 146. In addition, the pressure difference between the intermediate chamber 106 and the discharge chamber 102 causes the check valve 144 to close and thereby prevents communication between the intermediate chamber 106 and the suction chamber 96. When the control valve 110 is closed, the check valves 144, 146 prevent communication between the intermediate chamber 106 and the discharge chamber 102.

In various implementations, instead of using the check valves 144, 146, multiple control valves may be used to control the flow of gas from the discharge and intermediate chambers 102, 106 to the suction chamber 96. For example and with reference to FIG. 9, the control valve 110 controls communication between the intermediate chamber 106 and the suction chamber 96, and a control valve 150 such as a solenoid valve controls communication between the discharge chamber 102 and the suction chamber 96. A fourth line 152 may extend from the first line 112 to the control valve 150, and a fifth line 154 may extend from the control valve 150 to the discharge chamber 102. The control module 120 may control the control valve 150 in a manner similar to the manner in which the control module 120 controls the control valve 110 (e.g., in a pulsed manner using a PWM signal).

The control module 120 may control the control valves 110, 150 in at least two different ways. In one way, the control module 120 may open or close both of the control valves 110, 150 to disengage or reengage the orbiting and non-orbiting scrolls 68, 70. In another way, the control module 120 may individually open or close the control valves 110, 150 based on one or more operating conditions of the compressor 10 and/or a climate control system that includes the compressor 10. The operating conditions may include a suction pressure, a saturated evaporator temperature, a system discharge pressure, and/or a saturated condenser temperature.

For example only, the control module 120 may measure the suction pressure using a suction pressure sensor 156 located in the suction chamber 96. The control module 120 may measure the system discharge pressure using a discharge pressure sensor 158 located in the discharge chamber 102. Additionally or alternatively, the control module 120 may estimate or derive the suction pressure and the system discharge pressure based on the saturated evaporator temperature and/or the saturated condenser temperature. The control valve 150, the fourth line 152, the fifth line 154, the suction pressure sensor 156, and/or the discharge pressure sensor 158 may be included in the capacity modulation assembly 24.

The control module 120 may individually open or close the control valves 110, 150 based on whether the compressor 10 is over-compressing, under-compressing, or operating near a built-in pressure ratio. The compressor 10 may be over-compressing when the ratio of the discharge pressure to the suction pressure is less than the built-in pressure ratio. The compressor 10 may be under-compressing when the ratio of the suction pressure to the discharge pressure is greater than the built-in pressure ratio. The compressor 10 may be operating near the built-in pressure ratio when the ratio of the suction pressure to the discharge pressure is within a predetermined range of the built-in pressure.

The built-in pressure ratio is a ratio of the pressure within the scroll pockets 88 when the scroll pockets 88 are initially placed in communication with the discharge passage 100 to the pressure within the scroll pockets 88 when the scroll pockets 88 are initially sealed off from the suction passage 98. The built-in pressure ratio may be predetermined based on a built-in volume ratio of the compressor 10 and a polytropic coefficient of the media compressed using a relationship such as:

$$PR=VR^{PC}$$

where PR is the built-in pressure ratio, VR is the built-in volume ratio, and PC is the polytropic coefficient of the media compressed. The built-in volume ratio is the volume within the scroll pockets 88 when the scroll pockets 88 are initially sealed off from the suction passage 98 to the pressure within the scroll pockets 88 when the scroll pockets 88 are initially placed in communication with the discharge passage 100.

When the compressor 10 is over-compressing, the control module 120 may open the control valve 110 to disengage the orbiting and non-orbiting scrolls 68, 70 while the control valve 150 is held closed. When the compressor 10 is under-compressing, the control module 120 may open the control valve 150 to disengage the orbiting and non-orbiting scrolls 68, 70 while the control valve 110 is held closed. When the compressor 10 is operating near the built-in pressure ratio, the control module 120 may open both of the control valves 110, 150 to disengage the orbiting and non-orbiting scrolls 68, 70.

Figure 9:
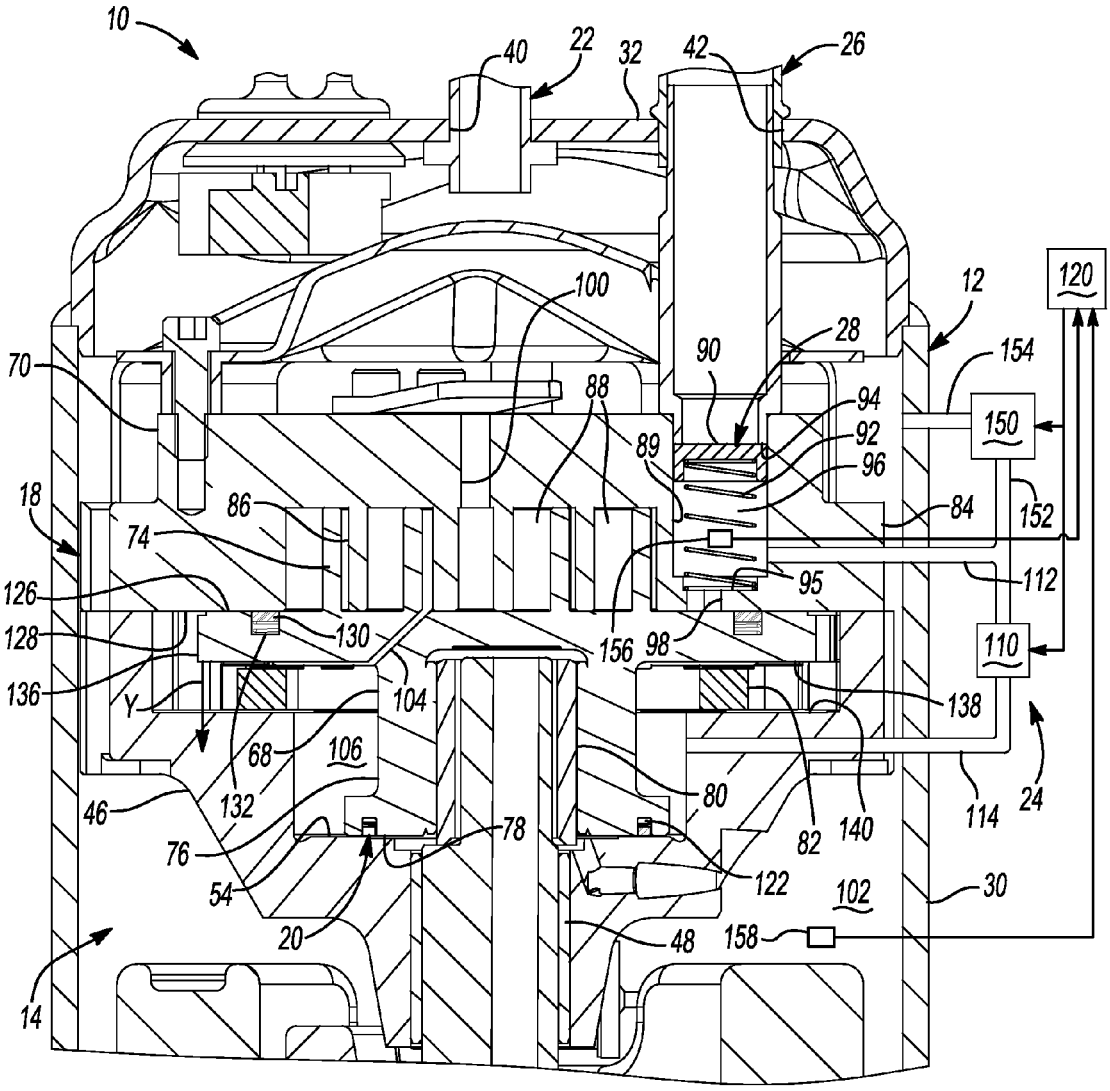
FIG. 9 is a section view of a portion of a fourth alternative embodiment of a compressor assembly according to the present disclosure.

In FIGS. 8 and 9, the seal assembly 20 is shown disposed in the annular groove 122 in the orbiting scroll 68 and including a seal and a spring that biases the seal against the annular flat surface 54 on the main bearing housing 46. It should be appreciated that the seal of the seal assembly 20 and the spring of the seal assembly 20 may be similar to the annular seal 130 and the annular biasing member 132, respectively, which are shown in FIG. 8A.

Figure 10:
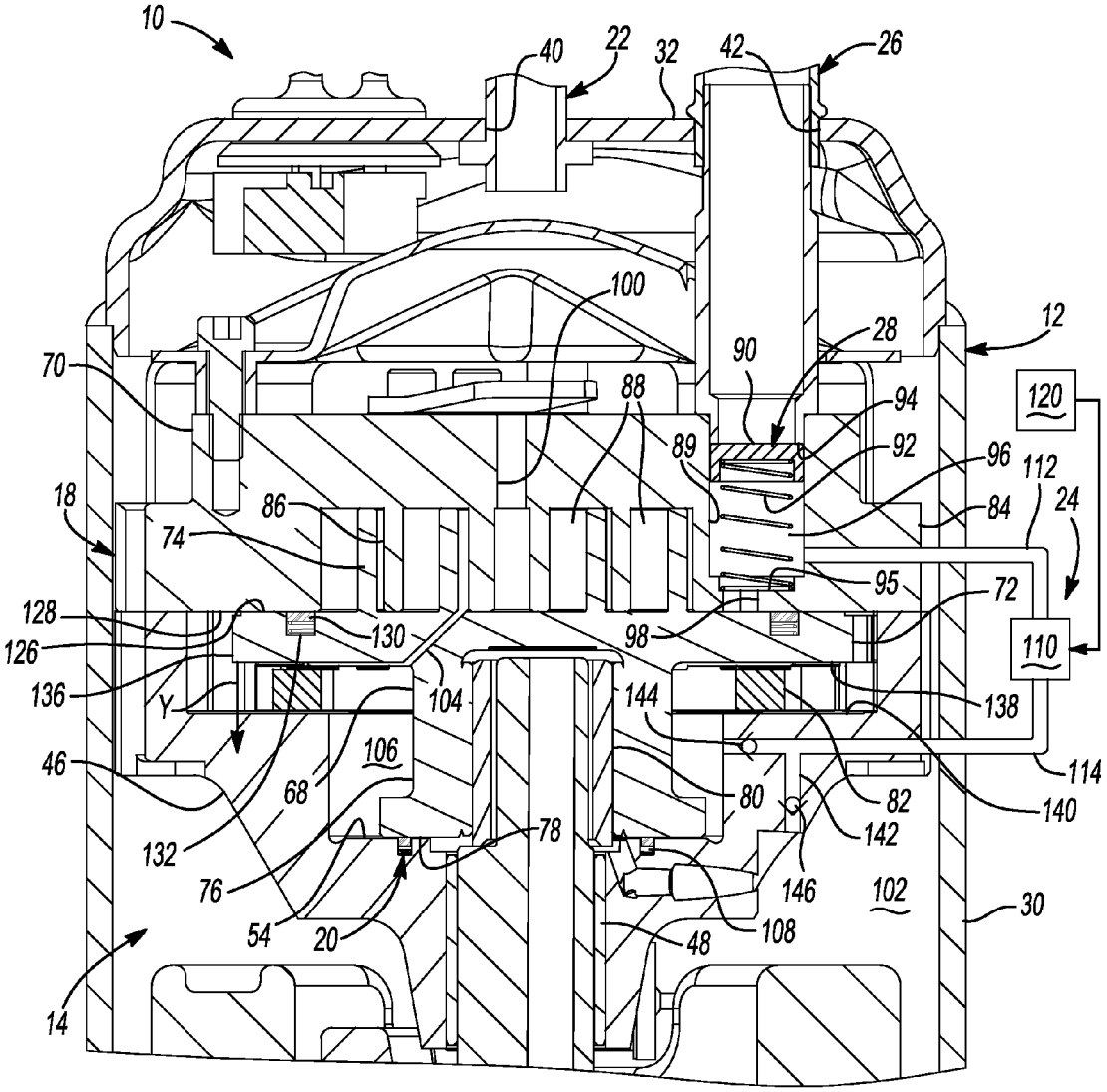
FIG. 10 is a section view of a portion of a fifth alternative embodiment of a compressor assembly according to the present disclosure.

FIG. 10 illustrates a variation of the embodiment of FIGS. 8 and 8A in which the seal assembly 20 and the corresponding interfaces on the main bearing housing 46 and the orbiting scroll 68 are configured as shown in FIG. 2. In other words, the main bearing housing 46 defines the annular groove 108, the seal assembly 20 is disposed in the annular groove 108, and the spring of the seal assembly 20 biases the seal of the seal assembly 20 against the annular flat surface 78 on the orbiting scroll 68. In addition, the orbiting scroll 68 does not define the annular groove 122 in contrast to the depiction of the orbiting scroll 68 in FIG. 8.

Figure 11:
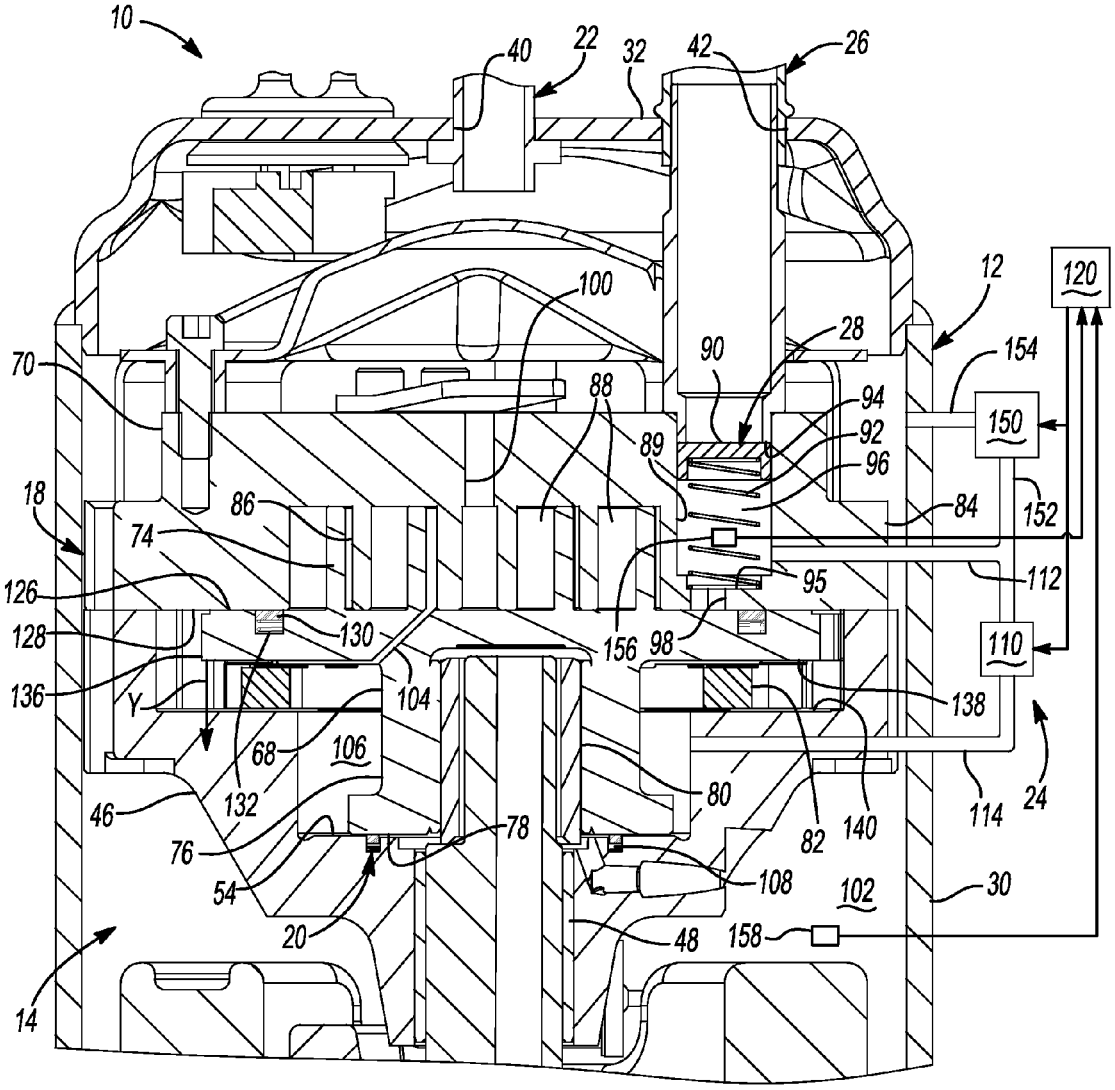
FIG. 11 is a section view of a portion of a sixth alternative embodiment of a compressor assembly according to the present disclosure.

FIG. 11 illustrates a variation of the embodiment of FIG. 9 in which the seal assembly 20 and the corresponding interfaces on the main bearing housing 46 and the orbiting scroll 68 are configured as shown in FIG. 2. In other words, the main bearing housing 46 defines the annular groove 108, the seal assembly 20 is disposed in the annular groove 108, and the spring of the seal assembly 20 biases the seal of the seal assembly 20 against the annular flat surface 78 on the orbiting scroll 68. In addition, the orbiting scroll 68 does not define the annular groove 122.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A compressor comprising:

a shell defining an opening that receives a suction gas inlet fitting in communication with a suction pressure region disposed within the shell;

a bearing housing fixed relative to the shell;

a compression mechanism located within the shell, supported on the bearing housing and in communication with the suction pressure region, the compression mechanism including an orbiting scroll and a non-orbiting scroll that include spiral wraps defining compression pockets therebetween, at least one of the orbiting scroll and the non-orbiting scroll defining an intermediate passage that provides communication between the compression pockets and an intermediate pressure region disposed within the shell, the intermediate pressure region defined by the bearing housing, an end plate of the orbiting scroll and a hub of the orbiting scroll that extends axially from the end plate;

a capacity modulation assembly including a first control valve, a first line, and a second line, the first line extending between the suction pressure region and the first control valve, the second line extending between the intermediate pressure region and the first control valve, the first control valve selectively opening to provide communication between the intermediate pressure region and the suction pressure region and thereby separate the orbiting scroll and the non-orbiting scroll to reduce the capacity of the compressor; and a suction valve assembly that includes a cap and a spring, the spring biasing the cap toward an end surface of the suction gas inlet fitting, the cap preventing communication between the suction gas inlet fitting and the suction pressure region when the cap engages the end surface of the suction gas inlet fitting.

2. The compressor of claim 1, wherein the first control valve includes a valve body, a solenoid coil, and a valve stem, the valve body defining a first bore extending between the first and second lines, the valve stem extending into the first bore when the first control valve is closed to prevent communication between the first and second lines.

3. The compressor of claim 1, wherein the intermediate passage is defined in the orbiting scroll and the intermediate pressure region is defined between the orbiting scroll and the bearing housing.

4. The compressor of claim 3, further comprising a seal assembly disposed between the orbiting scroll and the bearing housing, the seal assembly preventing communication between the intermediate pressure region and a discharge pressure region disposed within the shell.

5. The compressor of claim 1, wherein the non-orbiting scroll defines a bore, the suction valve assembly is disposed in the bore, and the spring is captured between the cap and an end surface of the non-orbiting scroll at an end of the bore.

6. The compressor of claim 1, wherein the capacity modulation assembly further includes a first check valve, a second check valve, and a third line, the first check valve being disposed in the second line at a location between the intermediate pressure region and an intersection between the second line and the third line, the second check valve being disposed in the third line, the third line extending between the second line and a discharge pressure region disposed within the shell.

7. The compressor of claim 1, further comprising a control module that cycles the first control valve using a pulse width modulated (PWM) signal.

8. The compressor of claim 1, further comprising a motor that drives the orbiting scroll, wherein at least one of the compression mechanism and the motor is disposed within a discharge pressure region disposed within the shell.

9. A compressor comprising:

a shell defining an opening that receives a suction gas inlet fitting in communication with a suction pressure region disposed within the shell;

a bearing housing fixed relative to the shell;

a compression mechanism located within the shell, supported on the bearing housing and in communication with the suction pressure region, the compression mechanism including an orbiting scroll and a non-orbiting scroll that include spiral wraps defining compression pockets therebetween, at least one of the orbiting scroll and the non-orbiting scroll defining an intermediate passage that provides communication between the compression pockets and an intermediate pressure region disposed within the shell; and a capacity modulation assembly including a first control valve, a first line, and a second line, the first line extending between the suction pressure region and the first control valve, the second line extending between the intermediate pressure region and the first control valve, the first control valve selectively opening to provide communication between the intermediate pressure region and the suction pressure region and thereby separate the orbiting scroll and the non-orbiting scroll to reduce the capacity of the compressor, wherein the capacity modulation assembly further includes a second control valve, a third line, and a fourth line, the third line placing the second control valve in communication with the suction pressure region, the fourth line placing the second control valve in communication with a discharge pressure region disposed within the shell, the second control valve selectively opening to provide communication between the discharge pressure region and the suction pressure region and thereby separate the orbiting scroll and the non-orbiting scroll to reduce the capacity of the compressor.

10. The compressor of claim 9, wherein the first line enters the suction pressure region between the compression pockets and a suction valve assembly.

11. The compressor of claim 9, wherein the first control valve includes a valve body, a solenoid coil, and a valve stem, the valve body defining a first bore extending between the first and second lines, the valve stem extending into the first bore when the first control valve is closed to prevent communication between the first and second lines.

12. The compressor of claim 9, wherein the intermediate passage is defined in the orbiting scroll and the intermediate pressure region is defined between the orbiting scroll and the bearing housing.

13. The compressor of claim 12, further comprising a seal assembly disposed between the orbiting scroll and the bearing housing, the seal assembly preventing communication between the intermediate pressure region and a discharge pressure region disposed within the shell.

14. The compressor of claim 9, further comprising a control module that cycles the first control valve using a pulse width modulated (PWM) signal.

15. The compressor of claim 9, further comprising a motor that drives the orbiting scroll, wherein at least one of the compression mechanism and the motor is disposed within a discharge pressure region disposed within the shell.

16. A compressor comprising:

a shell defining a suction pressure region disposed within the shell and a discharge pressure region disposed within the shell;

a bearing housing fixed relative to the shell;

a compression mechanism located within the shell, supported on the bearing housing and in communication with the suction pressure region, the compression mechanism including an orbiting scroll and a non-orbiting scroll that include spiral wraps defining compression pockets therebetween; and a capacity modulation assembly including:

a control valve in communication with the suction pressure region and an intermediate pressure region disposed within the shell; and a control module that opens and closes the control valve in a pulsed manner to separate and reengage the orbiting and non-orbiting scrolls and thereby vary the capacity of the compressor;

wherein the control module opens and closes the control valve using a pulse width modulated (PWM) signal; and wherein the control module uses the PWM signal to control a ratio of a first period when the orbiting and non-orbiting scrolls are engaged to a sum of the first period and a second period when the orbiting and non-orbiting scrolls are separated.

17. The compressor of claim 16, wherein the first control valve includes a valve body, a solenoid coil, and a valve stem, the valve body defining a first bore extending between the first and second lines, the valve stem extending into the first bore when the first control valve is closed to prevent communication between the first and second lines.

18. The compressor of claim 16, wherein an intermediate passage is defined in the orbiting scroll and provides communication between the compression pockets and the intermediate pressure region, and wherein the intermediate pressure region is defined between the orbiting scroll and the bearing housing.

19. The compressor of claim 18, further comprising a seal assembly disposed between the orbiting scroll and the bearing housing, the seal assembly preventing communication between the intermediate pressure region and a discharge pressure region disposed within the shell.

20. The compressor of claim 16, further comprising a motor that drives the orbiting scroll, wherein at least one of the compression mechanism and the motor is disposed within the discharge pressure region disposed within the shell.

* * * * *